US005511594A

United States Patent [19]

Brennan et al.

[11] Patent Number: 5,511,594

[45] Date of Patent: Apr. 30, 1996

[54] MODULAR PHARMACY SYSTEM AND PHARMACY PROCESS

[76] Inventors: Eric L. Brennan, 1331 Willow St., San Diego, Calif. 92653; Arnold E. Rivero, 24922 Oxford Dr., Laguna Niguel, Calif. 92677; William S. Bohn, 25652 Nottingham Ct., Laguna Hills, Calif. 92653; Jean Pfeiffer, 9463 Grackle Ave., Fountain Valley, Calif. 92708; Robert R. Snider, 23812 Inverness Pl., Laguna Niguel, Calif. 92677

[21] Appl. No.: 903,235

[22] Filed: Jun. 23, 1992

[51] Int. Cl.[6] ..... B65B 1/04; B65B 3/04

[52] U.S. Cl. ..... 141/98; 141/100; 364/413.01; 53/415; 53/425; 454/187

[58] Field of Search ..... 364/413.01, 413.02, 364/468, 479; 53/415, 436.1, 174, 167, 132, 510, 425, 428; 141/1, 2, 9, 100, 95, 98, 85; 600/21, 22; 454/187

[56] References Cited

U.S. PATENT DOCUMENTS

| | | | |
|---|---|---|---|
| 4,587,793 | 5/1986 | Brennan et al. | 53/425 |
| 5,058,491 | 10/1991 | Wiemer et al. | 454/187 |
| 5,076,332 | 12/1991 | Lewis et al. | 141/9 |
| 5,153,827 | 10/1992 | Coutré et al. | 364/413.02 |
| 5,208,762 | 5/1993 | Charhut et al. | 364/478 |

*Primary Examiner*—Henry J. Recla
*Assistant Examiner*—Steven O. Douglas
*Attorney, Agent, or Firm*—George F. Bethel; Patience K. Bethel

[57] ABSTRACT

A modular pharmacy and a modular pharmacy system and process for the admixture of intravenous drugs and total parenteral nutrition solution which includes automatic daily computer download of hospital prescriptions and the daily compounding under controlled systematic aseptic conditions including individually controlled environments at each work station and following systematically controlled process steps.

31 Claims, 10 Drawing Sheets

MODULAR PHARMACY SYSTEM AND PHARMACY PROCESS

FIELD OF THE INVENTION

This invention relates to the field of pharmaceuticals and pharmacies and particularly to a modular pharmacy and to a modular pharmacy system with controlled work area environments and to a controlled process for the compounding of liquid pharmaceutical products under aseptic conditions and particularly liquid intravenous prescription drugs and total parenteral nutrition solutions for the intravenous feeding of essential nutrients directly into the bloodstream.

DESCRIPTION OF THE PRIOR ART

Recent surveys by the American Society of Hospital Pharmacy (ASHP) indicated that more than 13% of a hospital pharmacy budget accounts for the labor involved in the preparation of intravenous (IV) fluid admixtures. For the most part these IV admixtures have included solutions for total parenteral nutrition (TPN), intravenous piggyback (IVPB) antibiotics, chemotherapy, cardioactive and other drugs. At the same time, hospital pharmacies are experiencing increasing pressure to reduce the cost of health care while at the same time staying abreast of advanced medical technology.

The complexity of medical treatment in recent years has led to the increasing use of complex intravenous solutions and drugs. Consequently, a majority of hospital pharmacists believe that their time as well as their professional expertise is best spent in aiding in the clinical management of the patient by assisting the physicians and nurses in formulating the most efficacious pharmacologic and therapeutic regimens for patient treatment in the shortest possible time.

The present invention of Central Admixture Pharmacy Services (CAPS) seeks to relieve the time and cost burden currently shouldered by the individual hospital pharmacy. At the same time the present Central Admixture Pharmacy Services system and process improves the quality and sterility of intravenous solutions and shortens the time for filling of individual patient prescriptions.

The Central Admixture Pharmacy Services provides a consistent organized pharmaceutical preparation system and process capable of preparation of individual patient specific intravenous drug and nutritional admixtures as determined by an individual physician. The specific admixtures or prescriptions are prepared in increased amounts over shorter periods of time than is possible in most hospital pharmacies. At the same time, the process of formulating the individual prescriptions provides increased sterility, increased quality control, reduced prescription and ingredient error, and seeks to eliminate the possibility of cross contamination of, for example, chemotherapeutic IV and/or antibiotic solutions by air transmission.

SUMMARY OF THE INVENTION

The above described objectives and advantages are made possible through the provision of a free standing specialized pharmacy facility which is located on, or near to a hospital campus or near an area of local hospitals. The physical plant of the facility is designed for set up in a modular manner with work stations and rooms for accomplishment of specific steps of the prescription preparation process.

Since the pharmaceutical facility is designed in modular form, it can be standardized as to the most efficient arrangement of successive steps in the preparation of an individual prescription. Also, modular form facilitates the set up as a free standing location or, alternatively, inside of another facility such as a warehouse. Often with set up in a warehouse, connections can be made to existing plumbing and electricity to provide the required needs of the facility. Also, the pharmaceutical facility in modular form can be set up in place, and qualified in place according to state pharmacy regulations.

An additional advantage of the use of modular form is the ease with which the facility can be changed to conform to individual state pharmaceutical regulations required for licensing.

Each modular unit can be set up, sealed, and disinfected. This is made possible by the choice of materials, and the preconstruction of the modular units. At the same time, if necessary, the interior spaces can be rearranged and/or expanded as needed to provide more or less space for an individual work station or room.

The organization of the modular work stations permits the preparation of individual prescriptions in the most efficient, cost effective, as well as sterile manner possible. Environmental control of temperature, moisture, particle counts, and particularly air flow and pressure greatly contributes to the ultrapure aseptic high quality of the prescriptions prepared in the modular facility according to the invention process.

In particular, the air at specific work stations and in rooms is filtered to provide class 10,000 positive pressure air down to class 1000 or better positive pressure or negative pressure air. The class number, i.e. 100, refers to the number of particles in parts per million which will pass through a specific size micropore air filter. The individual work stations for the compounding of TPN solutions within a room are individually provided with positive pressure laminar flow class 100 air. The TPN compounding room itself is provided with filtered air of class 1000 or better.

Positive pressure air is used for the compounding of TPN solutions. Negative pressure air of class 1000 or better is provided in the rooms for the compounding of general pharmacy and chemotherapeutic drugs as well as for the compounding of antibiotics to prevent cross contamination.

By providing the process work stations with incrementally increasing air pressure from work stations requiring less stringent air purity to a higher positive air pressure for the work stations requiring the highest standards of purity, there is provided the most favorable conditions for control of air purity. Similarly, providing the antibiotic and general pharmacy/chemotherapy work stations with negative air pressure ensures complete exhaust of air within the facility and complete trapping of biohazards from the facility through a filter.

In addition to negative pressure, a class 100 laminar flow biohazard hood is used for reconstituting and compounding of antibiotics, chemotherapeutic and general pharmacy prescriptions in order to prevent or minimize the escape of compounds into the air. The use of a class 100 biohazard hood keeps each process separate, increases the safety of individual technicians and reduces the chance of cross contamination between prescriptions.

Total exhaust of the air from the building through the negative pressure rooms and through the biohazard hoods therein ensures the removal of all biohazards which are trapped on a filter which is disposed of according to state laws for hazardous waste.

In addition, in the most preferred embodiment, the modular pharmacy system includes an on-site water purification apparatus for providing purified water to the purity standard of Water For Injection, U.S.P. This purified water can be used in the compounding of prescriptions as well as for the cleaning and wash down of walls, floors, ceilings, bottles, and equipment used in the preparation of the prescriptions.

In each of the individual rooms which can accommodate one or more work stations, the temperature, moisture and air pressure can be separately controlled. Also, air pressure and sterility of air can be separately controlled at individual work stations within the same room. Air pressure within individual rooms can range from negative to ambient pressure to positive pressure as required. Positive air pressure prevents inflow of particles and negative air pressure prevents outflow of particles to provide segregation of work environments.

The individual rooms and individual work stations can be provided with sterile air by filtration through high efficiency particulate air (HEPA) filters. For control of individual work stations within a room, laminar flow class 100 air is provided by means of a blower in conjunction with a HEPA filter which is disposed over an individual work station. This arrangement causes the filtered air to flow downwardly over the work station.

In an area where positive air pressure is desired, the positive air pressure prevents entry of air from outside the enclosure and enables the use of rigid or flexible walls as desired. Even overlapping strips of plastic or a plastic curtain in the entry areas is possible without appreciable loss of air purity.

Generally, the air filter used is one providing air filtration efficiency of 99.99% or better for 0.5 micron size particles. Most preferably, the high efficiency particle air filter has the same efficiency for rejection of 0.3 micron size particles.

The invention is directed to the preparation of sterile intravenous total parenteral solutions (TPN), intravenous (IV) general pharmacy and chemotherapy solutions, and intravenous antibiotic solutions.

Total parenteral solutions comprise required amounts of carbohydrates, proteins, fats, vitamins, minerals and water. The relative amounts of these ingredients will vary with the requirements of an individual patient and is prescribed by a physician. Proteins in the form of primary and secondary amino acids, carbohydrates in the form of dextrose or glucose, and water make up the major proportions of the TPN solutions. Minor amounts of other ingredients such as minerals, fatty acids, vitamins, and medicines make up the minor proportions of these solutions.

TPN solutions are commonly contained within a sterile, clear plastic bag having a tube with a luer lock connection at its distal end. The luer lock connection is connected to the patient's catheter and infusion takes place over an extended period of time.

Since TPN solutions as well as other IV solutions are infused directly into the blood stream, it is essential that they be sterile to avoid the introduction of pathogens into the body.

U.S. Pat. No. 4,587,793 describes the aseptic preparation of TPN and other IV solutions under aseptic conditions. It is particularly directed to a process and apparatus for preparing large scale batches of TPN solutions for specific patients which would supply a month's supply to enable patients under long term or life TPN nutrition requirements to live at home. Since the requirements for storage are for up to a month, the sterility requirements are extremely stringent. The current system and process is designed for daily preparation of prescription drugs for immediate, same day or next day use. Thus, the requirements are different than for that of the current invention.

The process of the instant invention is designed for reception of prescriptions from a hospital, preparation thereof and delivery back to the hospital or other originating facility within a short period of time, for example, in as little as one hour in some instances.

A reception and computer work station receives individual patient specific prescriptions from a hospital pharmacy or clinic. Preferably, the hospital pharmacy is provided with or constructs a particular computer application which is compatible with that of the modular pharmacy. However, the process of the invention is not limited thereto since the computer system is designed to read any ASCII file interface with the hospital's pharmacy system.

Most preferably, the hospital extracts its prescriptions from its active data bases and stores the data in an ASCII text file, which is then accessed by the CAPS computer system and imported into the CAPS system for processing and filling. In addition, the hospital pharmacy can send the prescription orders to the modular pharmacy in person, by facsimile, and by telephone.

According to the preferred process, prescriptions are received or automatically computer downloaded at optimal times during the customer's business process.

Upon receipt of the prescription orders, the number of orders, the number of drugs, dosage, frequency, units and the like are noted. The prescriptions are checked against known ingredient limits for similar prescriptions by a registered pharmacist (RPh).

Next, a computer pick list is generated for the raw materials and equipment including TPN bags, IVPB minibags, and syringes needed for the number of prescriptions (Rx) ordered. A computer check is then made of the inventory of raw materials needed from raw materials storage.

The technicians and pharmacists working within the process work stations and rooms don surgical scrubs. The needed raw materials and equipment are then loaded onto supply carts for transfer to a process preparation room. Prior to transfer, the cart, materials containers and equipment are wiped down to remove particles and reduce possible contamination.

At the process preparation center, the materials needed for TPN solutions are preweighed and measured for compounding.

Some solutions for use in formulating total parenteral nutrition solutions (TPN) are made up extemporaneously as needed in relatively large quantities. These solutions are prepared from liquid and dry ingredients and purified water in containers equipped with a mixer and placed on a hot plate. One or more containers and associated equipment are supported on carts.

After formulation of the large scale solutions, a sample of each of the prepared solutions is sent to an on site analysis and control testing station to check for content, purity, and pyrogens (LAL).

After the solutions have been checked, the carts are then transferred when needed into a wipe down room where the carts and the exterior of the containers holding the premixed solutions and equipment used in the compounding are wiped down with an alcohol or other antiseptic solution to remove particles and microorganisms.

The wiped down carts with the solutions are then transferred to a TPN compounding room having a work station or area for TPN sterility filtering and compounding of the large scale solutions and a micro admix work station or area for addition of microadditives.

The large scale solutions are generally greater than 1 liter but can be as low as required for special prescriptions. The microadditives are generally about 50 ml or less. The TPN compounding room is maintained at a positive air pressure and to a class 1000 standard.

All of the TPN units for a particular patient are filled at one time according to each patient's prescription label. If large scale solutions have been prepared, they are filtered prior to use. Pre-filtered solutions can also be used. Since prefiltered solutions are sterile, they are not filtered but are transferred to TPN bags using pre-sterile components at a work station under class 100 air conditions.

Filling using the CAPS mixed large scale solutions is done at a process work station under a class 100 laminar flow of air by means of a compounder consisting of, for example, six bottles of the premixed solutions which are sterile filtered prior to use in filling the TPN bags according to the patient specific prescription. Typical CAPS mixed TPN solutions dispensed by means of the compounder include primary amino acids, secondary amino acids, dextrose, electrolytes, fats, and purified water.

The CAPS mixed solutions prepared by extemporaneous compounding are sterile filtered through a micropore sterility filter prior to introduction into the compounder. The metering of the prescription amounts of the various ingredients from each of the bottles is effected by computer control of a volumetric pump or a pump that works in conjunction with a scale. In this fashion, exact metered amounts of each of the filtered premixed solutions are introduced into a sterile, clear, plastic bag through a fill port.

A registered pharmacist checks each prescription and signs it off as correct. The filled sterile bags are then transferred to a micro admix work station provided in the same room where small amounts of about 50 ml or less of other microadditive ingredients are introduced through the fill port or, if desired, injected through an injection port under a class 100 laminar flow of air. These ingredients include, for example, vitamins, electrolytes, and the like.

Each of the required additions are first drawn up in an established sequence according to the prescription. Before the addition of each of the microadditive ingredients and the like, the pharmacist double checks each individual ingredient additions against the printed label attached to the bag.

When the microadditives are checked as correct, each additive is added sequentially to each TPN bag. When all of the bags for a specific set of prescriptions have been filled, they are sealed and transferred to a product release work station.

At the product release work station, the pharmacist makes a final label check and compares it with a printout of the delivery list. If the final check is approved, the product is then released and delivered to the hospital.

As above described, the preparation of the prescription takes place in successive steps. The compounding on a large scale is done by personnel wearing surgical scrubs. Any compounding and mixing in the TPN compounding room is done with personnel clothed in a clean room gown. A clean room gown is a class 100 gown which refers to the number of particles generated by the gown. It comprises a one piece suit with a hood. In addition, a hair net and face mask are worn as well as disposable shoe covers and booties, and clean latex gloves. Tacky mats are provided at the entrances to the compounding rooms and elsewhere within the pharmacy to catch and hold particles from the soles of shoes.

The preparation of general pharmacy/chemotherapy and antibiotics prescriptions is accomplished in a similar fashion as for TPN solutions except that the compounding is most often done with sterile powders or sterile solutions which have been prefiltered and presterilized by a commercial manufacturer.

The compounding takes place in a class 1000 or better negative air pressure room at a work station under a negative air pressure laminar flow class 100 biohazard hood. The provision of a class 100 biohazard hood minimizes the possibility of any particles of the chemotherapy or antibiotic solutions from entering the air of other work stations or other rooms of the modular pharmacy facility. Preferably, antibiotic compounding is done in a separate room from the general pharmacy and chemotherapy/general pharmacy compounding or reconstitution.

Compounding generally includes reconstituting a drug from a powder in a closed bag by the addition of water and agitation under closed conditions. This is followed by dilution of the drug to the required dose concentration. Filling of syringes or minibags for general pharmacy/chemotherapy drugs is conducted under a negative air pressure biohazard class 100 laminar flow hood using a volumetric pump.

Filling of syringes or IVPB minibags for antibiotics can take place under a negative pressure biohazard class 100 laminar flow hood but can also be conducted at a process work station under positive pressure air class 100 laminar air flow within a positive pressure class 1000 air room.

The equipment used in the preparation of prescriptions is cleaned or sterilized as by autoclaving at a process preparation work station.

One of the advantages of IV solutions prepared by the above described system and facilities is that undesirable preservatives are not needed since the parenteral solutions are prepared daily and used within a short period of time.

Also, the small period of time between prescription preparation and use minimizes the possibility of formation of degradation products which are found in some commercially prepared, large volume parenteral solutions. In addition, the process of the invention also permits the preparation of specialized nutrient solutions which are not commonly available today.

In order to maintain quality and sterility, the process steps for compounding, sterile filtering and/or filling, and admixture of the IV solutions are verified on a regular basis.

A step by step process in a detailed written form is followed for each modular pharmaceutical facility. Also, the products are regularly sampled and sent to an independent lab for analysis as to chemical content, accuracy of admixture filling, and stability of ingredients. Microbiological evaluation including growth inhibition is also conducted regularly in order to insure the sterility of the solutions prepared according to the process.

On at least a monthly basis the processes are evaluated to determine if microbiological growth might occur during the process. This can be accomplished, for example, by passing standard method, tryptic soy broth through the process vessels, filling lines, and sterilizing filters followed by dispensing into sterile intravenous fluid transfer bags. These bags are then incubated along with a positive control for seven days to determine whether microbiological growth occurs.

Other process control release tests are also conducted on a regular basis within each modular pharmacy facility. Examples of such release tests include amino acid formulation and identification, dextrose purity and concentration determination, Ph and the determination of the absence of pyrogen using the LAL (Limulus Amoebocyte Lysate) test method.

All of the modular pharmacy admixture personnel are individually qualified on a monthly basis. The qualification test includes a separate manual aseptic admixture test of ongoing process.

In addition, daily particle count and other environmental monitoring tests are conducted in each facility on a daily or weekly basis such as microbiological sampling of the air and critical work surfaces used in the preparation and compounding areas of the facility.

DESCRIPTION OF THE DRAWINGS

The invention will be more readily understood by reference to the description which follows taken with the drawings in which.

DETAILED DESCRIPTION OF THE INVENTION

Figure 1:
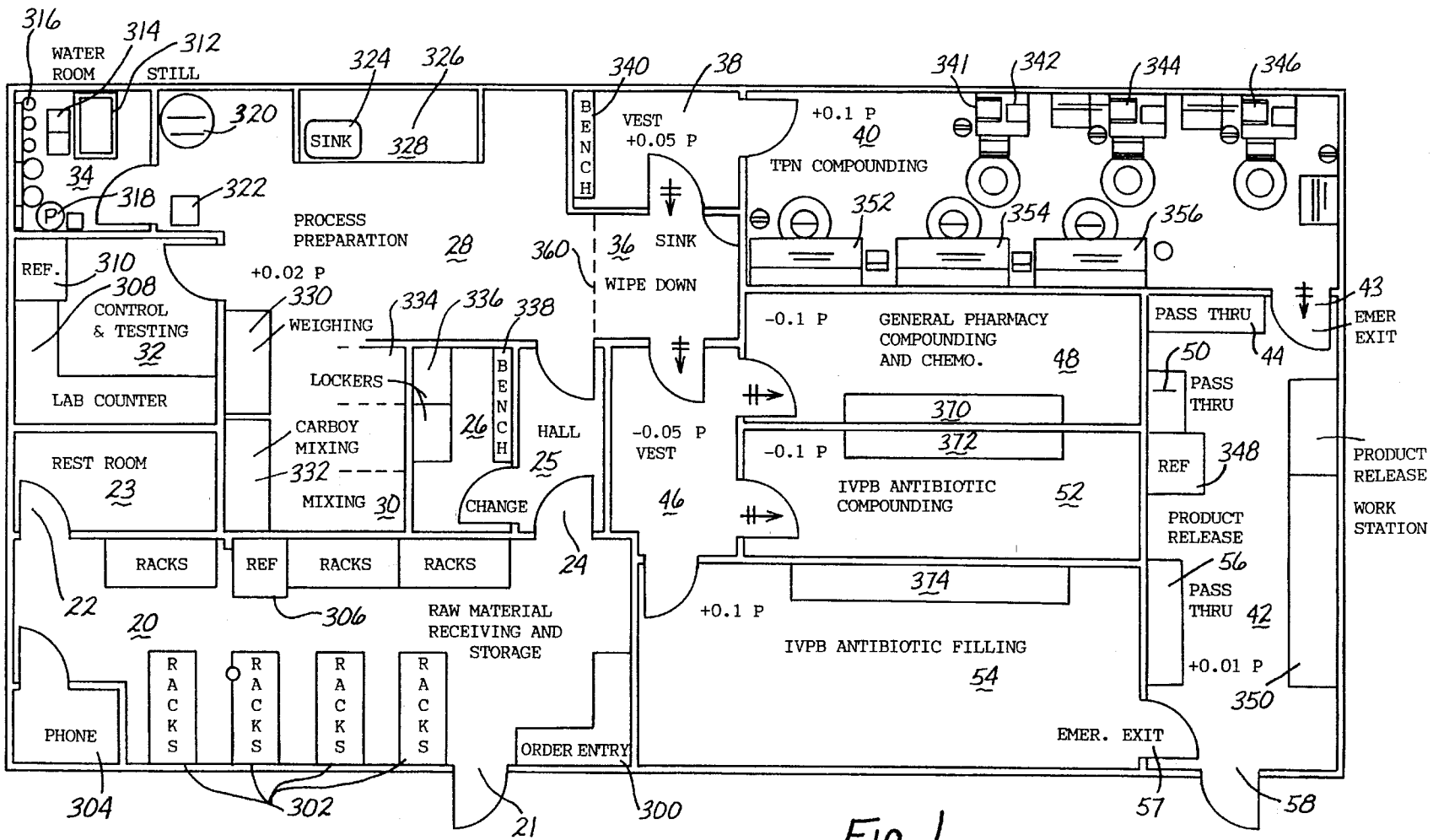
FIG. 1 shows a plan view of a modular pharmacy according to the invention.

Referring now to FIG. 1, there is shown a preferred modular pharmacy layout according to the invention. As shown, the facility is made up of three generally rectangular modular units attached together lengthwise and which are divided interiorly into separate rooms or enclosures. If more room is desired, additional modular units can be attached. For example, additional office space may be desirable which can be attached as a modular unit to the left side of the modular pharmacy.

Beginning at the left corner of the pharmacy, there can be seen a room 20 of a generally rectangular shape which is intended for use as a raw materials, receiving and storage center. In addition, a portion of the room can be utilized as an order entry center 300 with associated computer, printer, facsimile and the like.

The raw materials receiving and storage room 20 is normally provided with racks 302 for storage of materials and is provided with a door 21 for entry from the outside. A small room 304 is used for telephone switching and connections.

Since the raw materials receiving and storage room 20 communicates with and is exposed frequently to the outside air, it is kept at ambient air pressure and is considered a "dirty room" compared to the other rooms of the pharmacy.

At the upper left-hand side of the raw materials and receiving room 20 is a door 22 leading into a restroom 23. At the upper right-hand corner of the raw materials room 20 is a door 24 leading to an entry hall 25 which communicates at its left side with a changing room 26.

Changing room 26 is provided with lockers 336 and a bench 338. In changing room 26, pharmacists, technicians and other workers can change from their street clothes to surgical scrubs prior to working within the "clean" areas in the pharmacy. Changing room 26 and entry hall 25 are kept at ambient pressure air conditions.

The hall 25 leads into a process preparation room 28 which communicates with an extemporaneous compounding room 30, a control, analysis and testing lab 32, and a water purification room 34.

These rooms, including the process preparation room 28, the extemporaneous compounding room 30, the control and testing lab 32, and the water purification room 34, are kept at a positive pressure of at least about +0.02 inch of water and the air provided to these area is filtered to a class 10,000 standard or better.

The provision of a positive air pressure prevents the intrusion of air from the hall 25 or from changing room 26 or the raw materials receiving and storage room 20.

The process preparation room 28 has a work station 328 which is shown equipped with a sink 324 and a counter 326. A cart 322 can be used to transport equipment from one work station to another.

Work station 328 is used primarily for cleaning and sterilizing of equipment and should include a sterilizer and associated equipment. It can also be used for weighing and measuring out the chemicals and solutions needed for the prescriptions orders although this can take place at the specific compounding areas.

Room 30 is used for extemporaneous large scale compounding of TPN solutions as needed and for preliminary preparation for the TPN compounding and filling.

As shown, room 30 is provided with a weighing area 330, a carboy mixing area 332, and compounding areas 334.

The control and testing lab or room 32 is used to verify content and purity of solutions which are prepared in the extemporaneous large scale compounding room 30 as well as to test the sterility, purity and content of antibiotic and other prescriptions used to fill syringes, IVPB minibags, and for TPN products prepared according to the invention process.

The control and testing room 32 can be provided with a refrigerator 310 and lab counter 308. Other associated equipment not shown would include among others a hot plate, stirrer, vortex, a pH meter, osmometer, bubble point test station for testing of filters with a source of nitrogen and connections, an incubator and a storage unit to contain plastic bottles, reagent containers, amber glass bottles, soy broth bottles, pipettes, culture tubes, and unused scales.

The water purification room 34 is used to purify water daily to a standard of Water For Injection, U.S.P. and tested for purity in the control and testing room 32.

As shown, the water purification room 34 is provided with a still 312, a pump 318, a brine tank 314 and water treatment cylinders 316 which would include among others, a carbon bed, a softener bed, a 5 micron filter, and the like. Purified water which is made daily is stored in a tank 320 outside of room 34.

The purified water is used in the compounding of the prescription products as well as for the cleaning and wipe down of equipment, floors, walls, ceilings, doors and the like.

The final compounding of the TPN prescriptions and the final compounding of prescriptions for filling syringes and chemotherapy and IVPB containers takes place under stringent filtered air as well as positive or negative air pressure conditions in rooms located generally on the right side of the modular pharmacy.

As shown, the process preparation room 28 communicates with a wipe down room 36 where all containers, equipment, and other apparatus and supplies are wiped down with alcohol or other antiseptic solution to remove microorganisms and all possible particles prior to being transferred into the TPN compounding or other compounding rooms.

The wipe down room 36 can be separated from the process preparation room 28 by means of a curtain 360.

The wipe down room 36 communicates with a vestibule 38 having a bench 340. Vestibule 38 is provided with positive air pressure of +0.05 inch of water and a class 1000 or better air standard. Here, registered pharmacists and technicians put on class 100 gowns over their surgical scrubs. The gown is a clean, one-piece suit with a hood, often called a bunny suit. A clean face mask is also put on as well as disposable shoe covers or booties. In addition, sterile gloves are worn during the compounding process. Preferably, these items are disposable.

The cart and equipment which has been wiped down in room 36 is then taken into the vestibule 38 and then into the TPN compounding room 40 where the prescriptions for TPN are filled. This is effected first with compounders 342, 344, and 346 which control computerized filling of filtered premixed TPN basic solutions. The additions of microadditives are effected in a separate process step at microadmix work stations 352, 354, and 356.

TPN compounding room 40 is provided with positive pressure air of +0.1 inch of water and a class 1000 or better standard. At the compounding and filling work station 341 above the compounders 342, 344, and 346 and above the microadmix work stations 352, 354, and 356 there is provided positive pressure laminar flow air of class 100 or better.

Upon completion of the TPN prescription compounding process, the products are transferred into the product release room 42 through a pass through opening 44. An emergency exit door 43 is kept closed.

The preparation of general pharmacy compounding and chemotherapy as well as IVPB antibiotic compounding is done under negative air pressure conditions.

After wipe down of the required raw materials, vials, solutions and other equipment in room 36, the technicians and pharmacists dress in clean room clothes in adjacent vestibule 46. Gowning is accomplished in the manner previously described for vestibule 38. Vestibule 46 is maintained at a negative air pressure of −0.05 inch water and a class 1000 standard.

The equipment which has been wiped down along with the compounding materials are then transferred into the general pharmacy compounding and chemotherapy room 48. This room 48 is also maintained at a negative pressure of −0.1 inch of water and a class 1000 standard or better. In addition, the room 48 is provided with a laminar flow class 100 biohazard hood 370 where all compounding and filling takes place.

Upon completion of the compounding and filling of syringes and minibags (IVPB), the finished product is transferred to the product release room through a pass through opening 50.

The preparation of antibiotic compounding takes place in room 52 which is adjacent vestibule 46. Antibiotic compounding room 52 is maintained at a negative air pressure of −0.1 inch of water and a class 1000 standard or better. It is also provided with a laminar flow class 100 biohazard hood 372 for the compounding of antibiotics.

After reconstitution of the antibiotic solutions in room 2, the solutions are transferred to the IVPB antibiotic filling room 54. This room 54 is maintained at a positive air pressure of +0.1 inch of water and a class 1000 standard or better. Filling takes place at a filling work station 374 which is provided with overhead laminar flow positive pressure air of +0.1 inch of water and a class 100 or better standard.

After filling of the syringes or IVPB minibags in room 54, they are transferred to the product release room 42 through a pass through opening 56. An emergency exit door 57 is kept closed.

The product release room 42 contains a refrigerator 348 and a product release work station 350.

At the product release room 42, the filled prescription products are grouped according to patient, and hospital floor in most instances. They are released for delivery through exterior door 58.

The modular facility shown in FIG. 1 is a preferred configuration. The invention is not limited by the actual configuration of the modular features or by the equipment provided within each module or room.

The modular pharmacy can be divided up into various rooms and process work areas or stations according to the needs of the particular pharmacy. For example, if large numbers of TPN prescriptions are regularly received, more rooms can be added to the modular pharmacy by addition of another module or by rearrangement of the interior of the pharmacy to permit more than one TPN compounding room. Similarly, while the modular pharmacy shown in FIG. 1 includes a separate antibiotic compounding room and a separate antibiotic filling room, these steps can be accomplished in the same room if desired.

Figure 2:
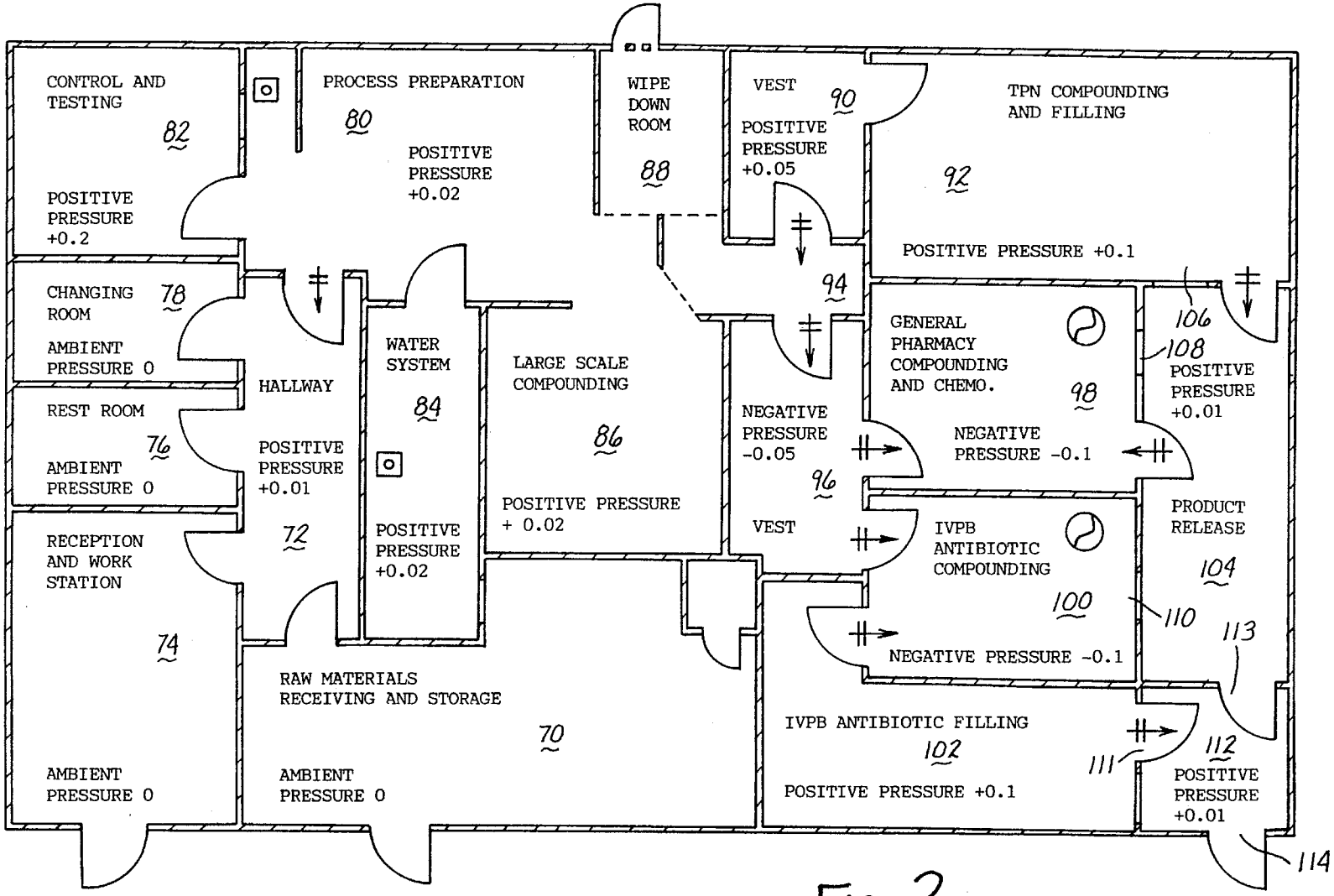
FIG. 2 shows a plan view of another embodiment of the modular pharmacy according to the invention.

An example of a slightly different configuration is shown in FIG. 2. As shown, a raw materials receiving and storage room 70 communicates with a hallway 72 which leads into a reception and computer station 74 containing the central computer and other office equipment.

The hallway 72 leads into a restroom 76 and a changing room 78. The far end of the hallway 72 opens into the process preparation area 80 which opens into control and testing room 82, water purification room 84, and extemporaneous large scale compounding room 86.

The modular pharmacy of FIG. 2 also includes a wipe down room 88, and a positive air vestibule 90 which leads into a TPN compounding and filling room 92.

Between the wipe down room 88 and vestibule 90 is a hallway 94 which communicates with a negative pressure vestibule 96 which opens into a general pharmacy and chemotherapy compounding room 98 and an IVPB/antibiotic compounding room 100.

The antibiotic compounding room 100 leads into the antibiotic filling room 102 in a slightly different arrangement from that of FIG. 1. The product release room 104 communicates with the TPN compounding room 92 through a pass through opening 106 and with the general pharmacy/chemotherapy compounding room 98 by means of a pass through opening 108. The antibiotic compounding room 100 communicates with the product release room 104 by means of a pass through 110.

A door 111 from the antibiotic filling room 102 leads into a hallway 112 which has a door 113 for communication with the product release room 104 and an entry door 114 from outside of the pharmacy.

It is particular feature of the invention to separately control the air purity and air pressure at individual rooms and individual work stations throughout the modular pharmacy. Proper arrangement of the modular pharmacy rooms and work stations to correspond to process steps requiring ever increasing air purity permits the maximizing of air purity in the room requiring the highest air purity conditions including the final compounding and filling of prescriptions.

For this reason, the reception and computer work station and the raw materials storage area are kept at ambient temperature and pressure conditions. These rooms experience the frequent entry and exit of persons involved with computer and other office matters as well as the delivery of raw materials as required.

Since none of the actual prescription preparation steps take place in these rooms, there is no special requirement for air purity. At the same time, it is desirable to prevent the intrusion of air from these rooms into the interior areas of the modular pharmacy where the process preparation steps are effectuated.

As a consequence, the novel modular pharmacy of the invention seeks to place positive pressure air within the facility to act as a barrier against intrusion of ambient air into the actual process rooms and work stations.

By grouping together the work stations for completion of process steps which do not require a high degree of air purity, it is possible to isolate these steps from the work stations which require a very high degree of purity. For example, the modular facility groups together the process work stations including the control and testing work stations, the room for production of water for injection, the process preparation room for equipment cleaning, sterilizing and set-up and the extemporaneous work station for as needed mixing of large scale TPN solutions. These rooms and process work stations are provided with a positive air pressure which is greater than that of the ambient pressure but less than that for the vesting, TPN compounding, antibiotic filling and product release rooms.

Also, the air purity for the process preparation, cleaning and testing rooms is less than that which is required for the TPN compounding, or general pharmacy/chemotherapeutic and antibiotic compounding. Thus, both the air purity and positive pressure is not as great as for the subsequent compounding process steps.

The vestibule of the TPN compounding room is held at a positive pressure which is slightly greater than the previously described work stations and less than that of the TPN compounding room. Thus, there is an incremental rise in air pressure moving from the process preparation room work stations and areas including the water purification work station, control and testing work station, and extemporaneous mixing of TPN solutions, to the vestibule, and then to an incrementally higher positive pressure in the TPN compounding room. The TPN compounding room has the highest positive pressure.

Of equal high positive pressure is the antibiotic filling room and then slightly less positive pressure is provided to the product release room.

The general pharmacy/chemotherapeutic compounding and filling room, the antibiotic compounding room and the vestibule for these rooms are kept at a negative air pressure. The air pressure for the vestibule is slightly less than that in the general pharmacy/chemotherapeutic and antibiotic compounding rooms to ensure air movement from the vestibule into the more negative air pressure rooms.

Within the negative pressure areas, there is a complete drawing of air from other areas so that all hazardous materials are completely exhausted from the building. This is augmented, of course, by the use of the negative pressure biohazard hood.

The antibiotic filling room is held to a positive pressure which is slightly greater than the positive pressure of the product release room insuring that there is no air intrusion from the positive pressure product release room into the antibiotic filling room so that purity can be maintained.

In this fashion, there is increasing positive air pressure coupled with increasing air purity and the possibility of cross contamination between rooms is certainly minimized by this process.

THE PROCESS

The novel process of the invention constitutes a detailed series of integrated steps which begin with the origination of a prescription in a hospital or other similar facility and ends with the delivery of the prescription product in a short period of time.

Figure 3A:
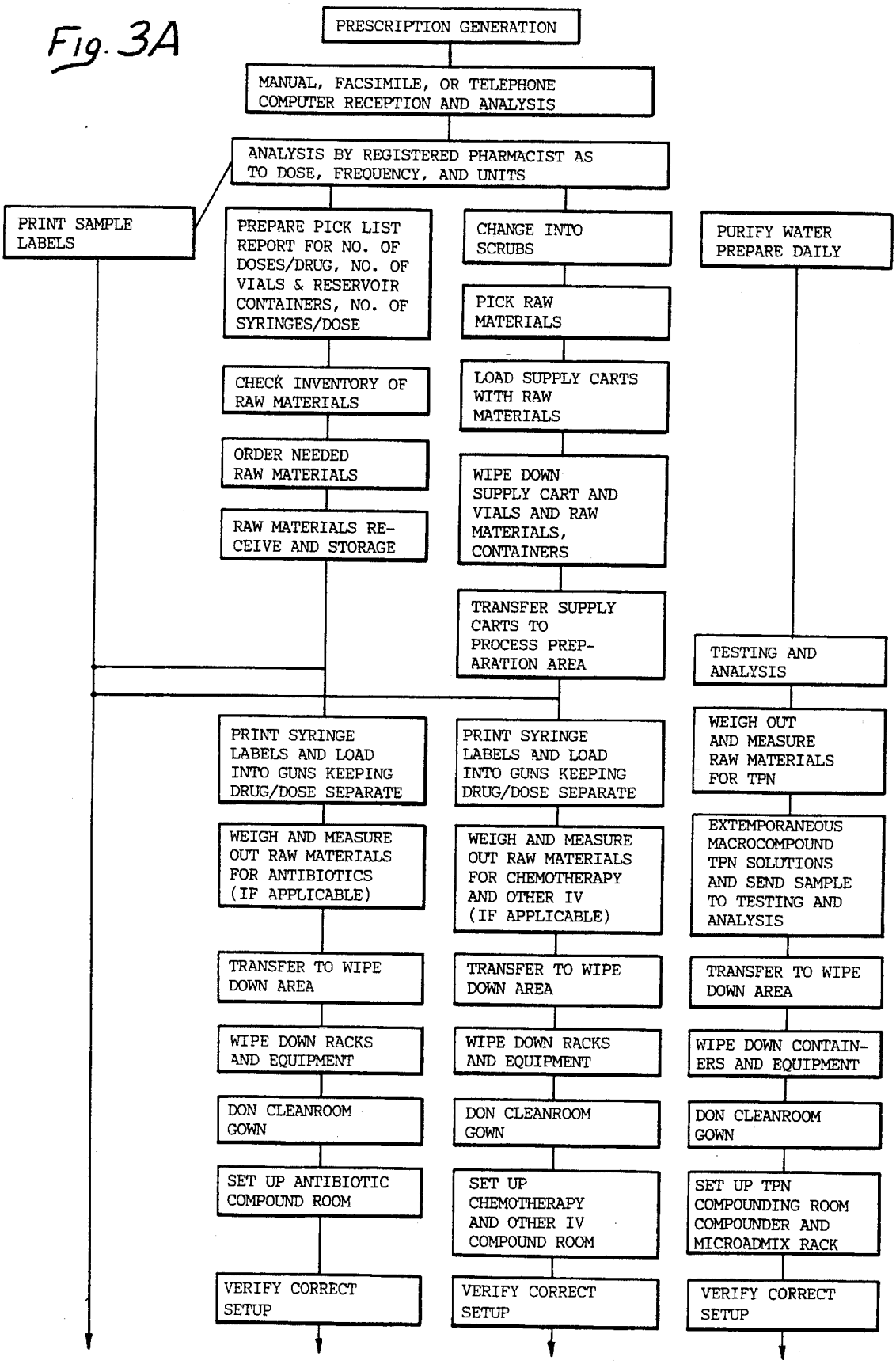
FIGS. 3A and 3B show an overall block flow diagram of the invention process.
Figure 3B:
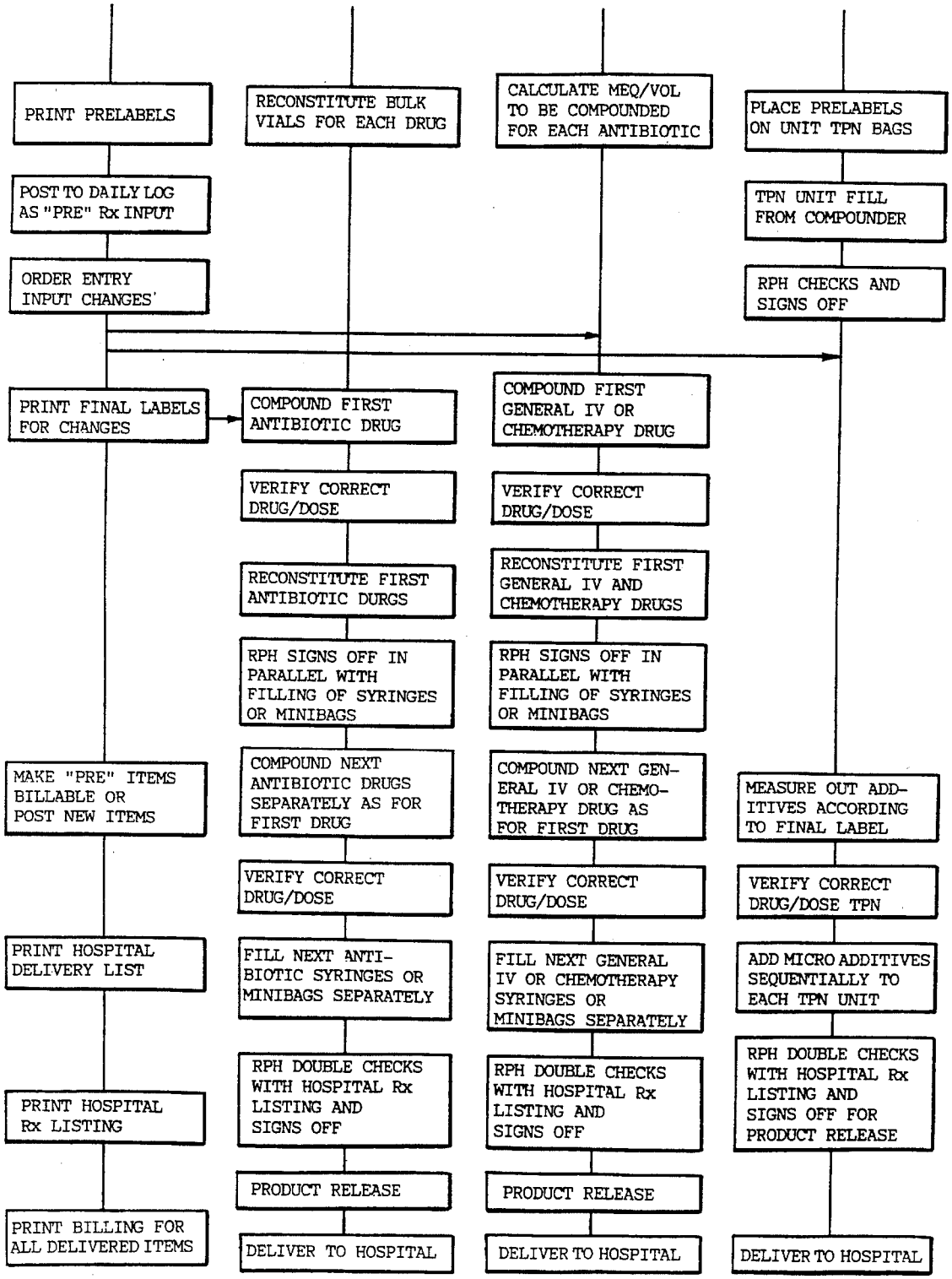

The more important steps of the process are highlighted in the pharmacy process flow chart shown in FIG. 3.

In general, the process as shown in FIG. 3 traces the steps which would be typical for the process followed on a daily basis.

The prescription is generated or written by a doctor at a hospital or clinic and then checked by generally an in-house pharmacist of the hospital or clinic. The prescription is then communicated to the modular pharmacy of the invention either by delivery, by facsimile, by telephone or preferably by computer communication.

It is a particular feature of this invention process and system to provide a means for automated computer order interface at periodic intervals throughout the day between a hospital pharmacy or clinic and that of the modular facility computer.

The modular pharmacy system and process of the invention in its most preferred form includes providing the hospital with a listing of procedural and data requirements necessary for establishing an automated computer interface with a modular pharmacy facility.

According to the process, the hospital extracts its current active prescriptions at certain predetermined periods throughout the day. Preferably, the computer files will be ASCII text based and formatted in a standard data structure which can be directly imported into the CAPS pharmacy computer system.

Preferably the files include a file header which defines the origin of the data from zero to many order records, and a file footer for organization within the file.

The order file preferably includes a record header, a type of order such as "TPN", "CHEMOTHERAPY", "ANTIBIOTIC", or OTHER. An ID number is required to uniquely identify each hospital order. In addition, the order file preferably would include a patient's name, the requesting pharmacist's name, initials, or ID number, the ordering physician's name, the hospital defined prescription number for the order, the sex of the patient, the height of the patient, the weight of the patient, the room where the patient is residing at the time of the order, the area or ward of the hospital where the patient is residing, the known allergies of the patient or none if none are known, the diagnosis of the patient, special instructions for the prescription, the number of bags/doses requested, the rate of delivery for the solution, detailed dose and concentrations required, the total kilocalories required, the total prescribed solution volume in milliliters, the duration of delivery, start date for the prescription, and the end date for the prescription.

In addition, there preferably would be included the name of each solution, additive, or drug name and also the quantity or concentration including the unit of measure and also the frequency of inclusion, for example, twice daily or once Monday/Thursday. Finally, there preferably would be an addition count which would include the dose summation and additive count for each prescription.

This additive count is used for double checking of the amounts of ingredients to prevent the possibility of the exclusion of an ingredient or the inclusion of an improper amount of an ingredient. The dose summation is a double check that correct doses were read for the order.

Also, there is preferably included a file summary which is used to mark the end of the file, time and date stamp the file, and provide error checksum capabilities. The format preferably should include a record header, the type of order, the total count of orders, the total count of solutions/additives for the file, the sum of all bag quantities, the date the file was created, and the time of day that the file was created, preferably in military time.

The information described above permits the computer analysis as a minimum of each individual patient specific prescription as to dose, frequency and units.

After reception of the first download of prescriptions a pick list is prepared based on the record summaries as to the number of doses, drugs, number of vials, and reservoir containers, number of bags, syringes, sterile tubing sets, and the like which are needed in order to prepare the prescription orders.

An inventory check of the raw materials and equipment is then conducted. If any materials and equipment are not available, they can be ordered and received within a short period of time.

On the basis of the pick list, the raw materials and equipment are then loaded from the raw materials and storage room onto a supply cart. This is followed by a wipe down of the supply cart, the vials, the raw material containers and the equipment to be used. This is normally done in the raw materials room 20 of FIG. 1 or raw materials room 70 of FIG. 2.

Within the areas where compounding takes place, the equipment surfaces as well as floor, walls and ceiling are rendered clean by means of washing with an antibacterial agent, such as water and chlorine bleach solution. Tacky mats are provided as needed to reduce particles from shoe soles.

In preparation for compounding the prescription orders, the registered pharmacists and technicians change from their street clothes into surgical scrubs in changing room 26 of FIG. 1 or in changing room 78 of FIG. 2.

When this has been accomplished, the technicians and pharmacists transfer the supply carts to a process preparation area as shown at 28 in FIG. 1 and 80 in FIG. 2. Here, the process preparation room which is equipped with a sink, an autoclave and other equipment including a scale, the materials are weighed out and measured for purposes of the compounding.

For antibiotic, syringe or IVPB orders, at the same time or after the download of the final orders, the syringe labels are printed and loaded into guns keeping the drug/dose separate.

The racks and equipment used for the compounding are then wiped down. The same time that this is taking place, the water which has been purified early in the day and stored in a reservoir container is then sent to testing and analysis to verify the purity of the water. When all of the needed materials have been measured out and the water purity has been verified, the compounding can begin.

The compounding of TPN solutions is somewhat different from the compounding of antibiotic, chemotherapy, and general IV solutions.

For the TPN solutions, the first step is comprised of the extemporaneous macrocompounding of the TPN ingredients as needed which comprise the largest amount of the final TPN solutions. These include primary and secondary amino acids, water, and dextrose. This extemporaneous large scale compounding takes place daily as needed in the extemporaneous mixing room as shown at 30 in FIG. 1 and at 86 in FIG. 2.

Figure 8:
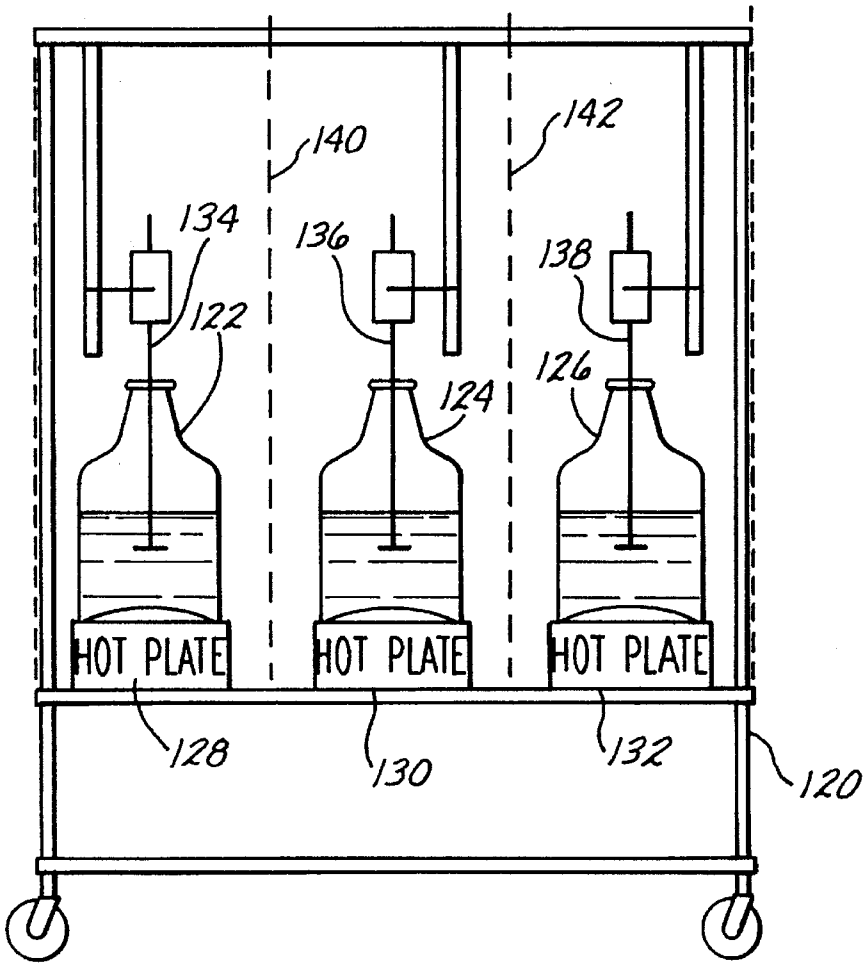
FIG. 8 shows a schematic diagram of the extemporaneous large scale compounding cart and equipment; and, FIG. 9 shows a sterile capsule filter.

In general, the compounding can be done on a cart as shown in FIG. 8. The compounding cart 120 includes a series of containers 122, 124, and 126 which are each placed on a hot plate 128, 130, and 132 respectively. Each container is equipped with a mixer 134, 136, and 138 respectively.

Between each of the containers 122, 124, and 126 is a plastic curtain 140 and 142 to minimize transfer of particles between containers during mixing.

The TPN solutions are prepared by mixing together dry materials with purified water and then mixing while heating to encourage the dissolution of the raw materials.

The TPN solution containers 122, the cart 120, and the mixer 138 are preferably made of electropolished 316L stainless steel. Electropolished 316L stainless steel is preferred since it is easy to sanitize, will not rust, and does not break.

After the extemporaneous macrocompounding of the TPN solutions is completed, a sample of each of these solutions is taken to the control and testing area for determination of content, and purity and pyrogen free. If the specifications as to content, purity, and pyrogen free are verified, the large scale TPN solutions are then released for use in preparation of the TPN final units.

The large scale solution containers are then transferred into the wipe down room 36 of FIG. 1 or room 88 of FIG. 2 where all of the equipment and associated materials and the cart itself are wiped down with an alcohol or other antiseptic solution to remove microorganisms and particles.

At this time the pharmacists and technicians put on class 100 gowns over their scrubs in the vestibule 38 of FIG. 1 or vestibule 90 of FIG. 2. as previously described.

The vestibules 38 and 90 have a positive pressure of about 0.05 inch of water and a class 1000 standard. After gowning, the TPN solutions are taken into the TPN compounding room as shown at 40 of FIG. 1 and 92 of FIG. 2.

The TPN compounding room is preferably held at a positive pressure of +0.1 inch of water and a class 1000 standard or better. This is made possible by filtration of air through a high efficiency particulate air filter which prevents contamination by air carried dust particles. The filtration efficiency is enhanced by directing the air in a unidirectional substantially lateral flow pattern across the room or enclosure. Also, preferably at least a portion of the air is refiltered and recirculated within the enclosure together with prefiltered makeup air to maintain the positive air pressure throughout the room.

As previously described, each work station within the TPN compounding room, including the TPN compounding work station and the microadmix work station is provided with positive pressure class 100 air which flows downwardly over each work station.

As noted above, the use of a positive air pressure prevents the entry of air from outside of the room.

A class 10,000, 1,000, or 100 standard refers to the efficiency with which the particulate air filter rejects particles as small as 0.3 microns. Preferably, the air within the clean room or enclosure is renewed 20 times per hour.

Prior to entry within the TPN compounding room 40, the walls, floor, ceiling and mixing equipment within the compounding room are previously cleaned by washing with an antibacterial solution. In addition, work surfaces and equipment, as well as parts of the walls and ceiling are regularly tested for bacterial growth count. Whenever possible, it is preferred that the equipment be composed of electropolished 316 stainless steel.

The tubing used in the refill system and mixing process is preferably composed of a clear plastic material which is capable of being sterilized and is further resistent to corrosive solvents and temperature extremes. Clarity of the plastic tubing material is preferred so that the flow within the tubing can be readily seen. Excellent results have been obtained using Tygon®, Tygon food®, silicone, and Viton® (a trademark of Dupont de Nemours Co.) and having an inner diameter of approximately ⅜ inch and an outer diameter of approximately ⅝ inch. Sterile IV sets fill this criteria and are preferably used.

For the extemporaneous mixing process, tubing connections are preferably made fluid tight by means of clamps and tubing connectors which are preferably made either of plastic or stainless steel or other materials which are capable of being sterilized by standard methods. Also, it is preferable that there be double clamping of the fill lines for extra surety in case of the failure of a clamp during the fill process.

During the compounding and filling process, the pump does not actually contact the product and therefore does not require sterilization. However, the surfaces should be treated with an antibacterial agent on a regular basis.

Figure 4:
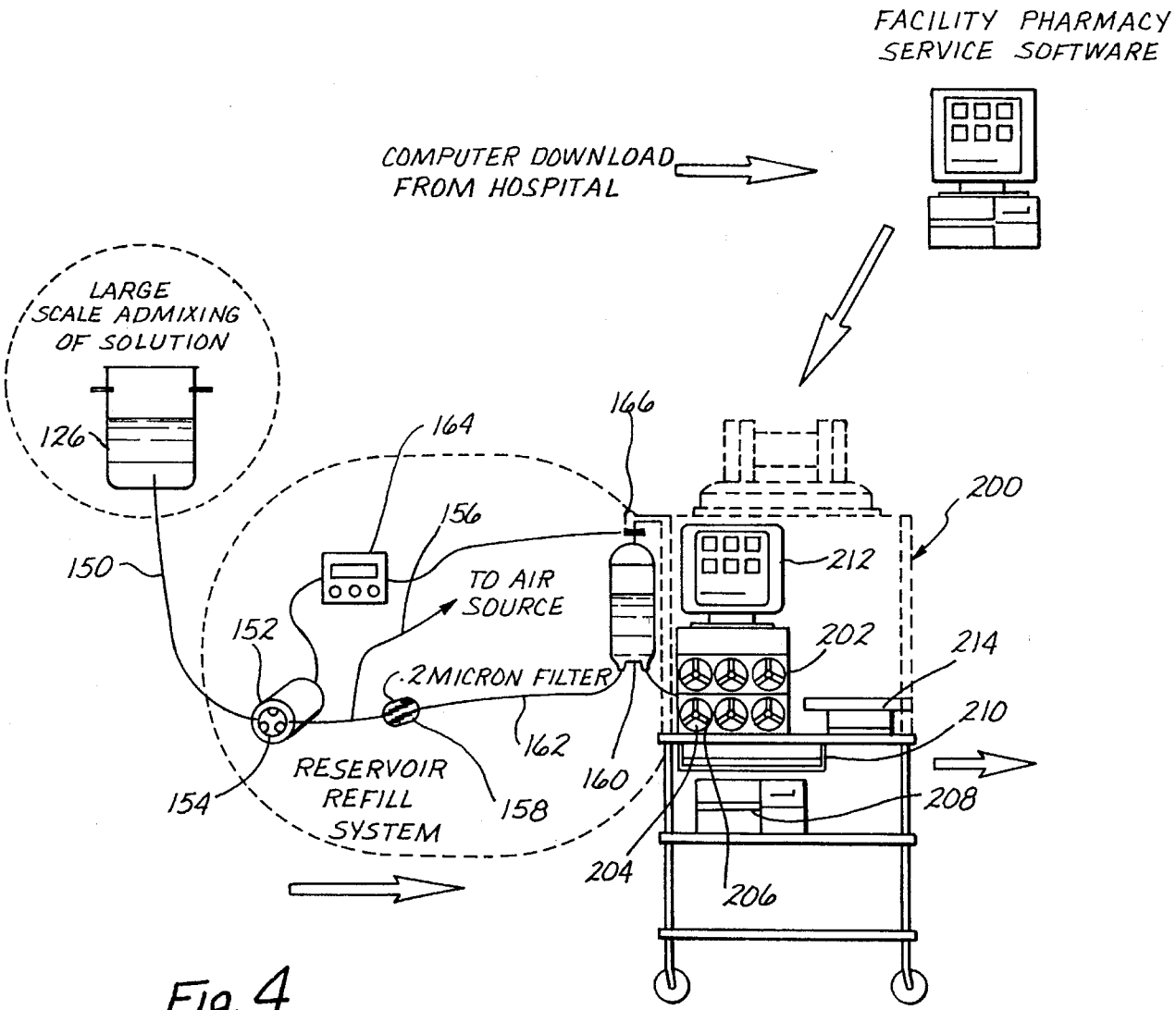
FIG. 4 shows a schematic view of the TPN compounding apparatus of the invention.
Figure 5:
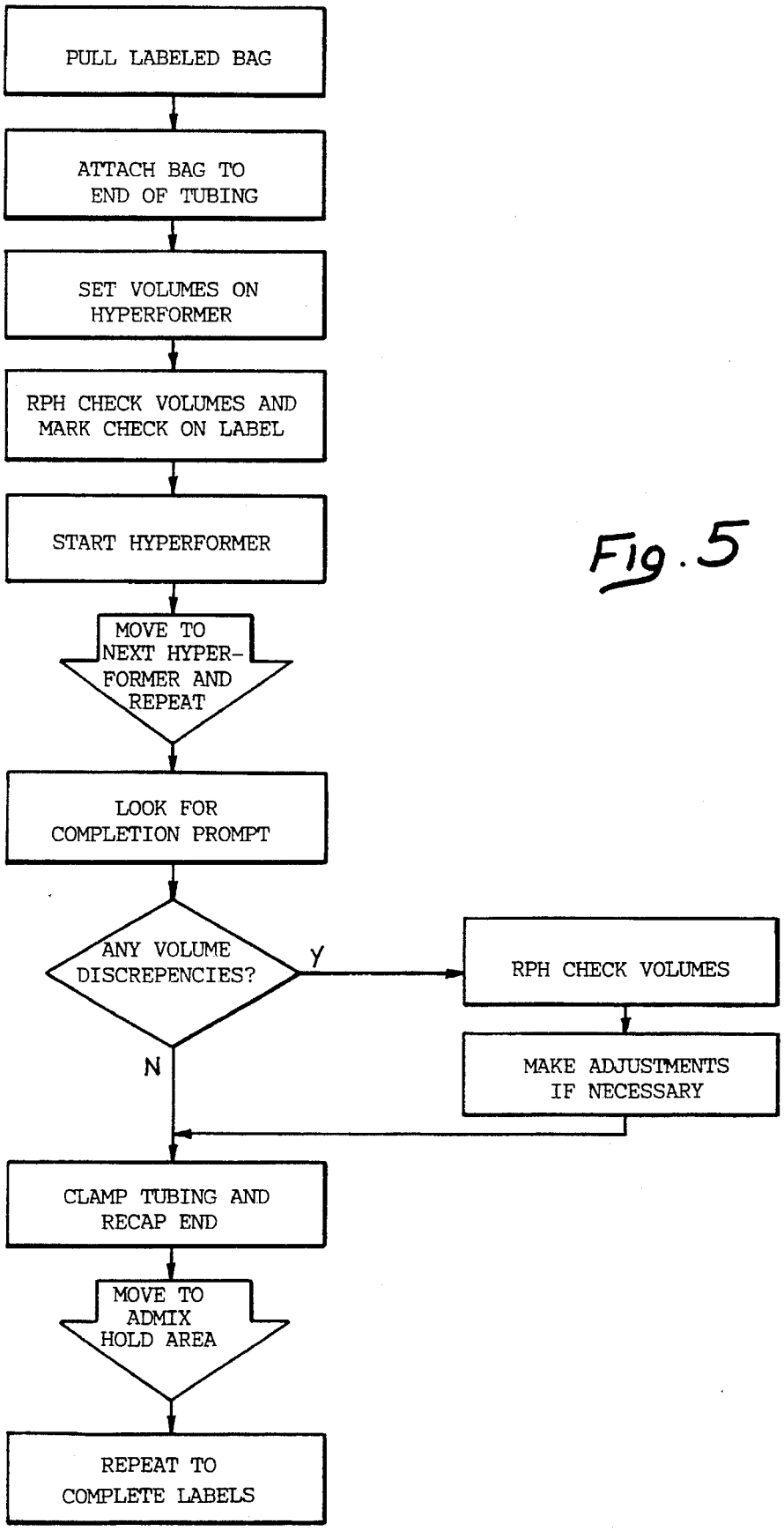
FIG. 5 shows a detailed flow chart for TPN compounder process.
Figure 6:
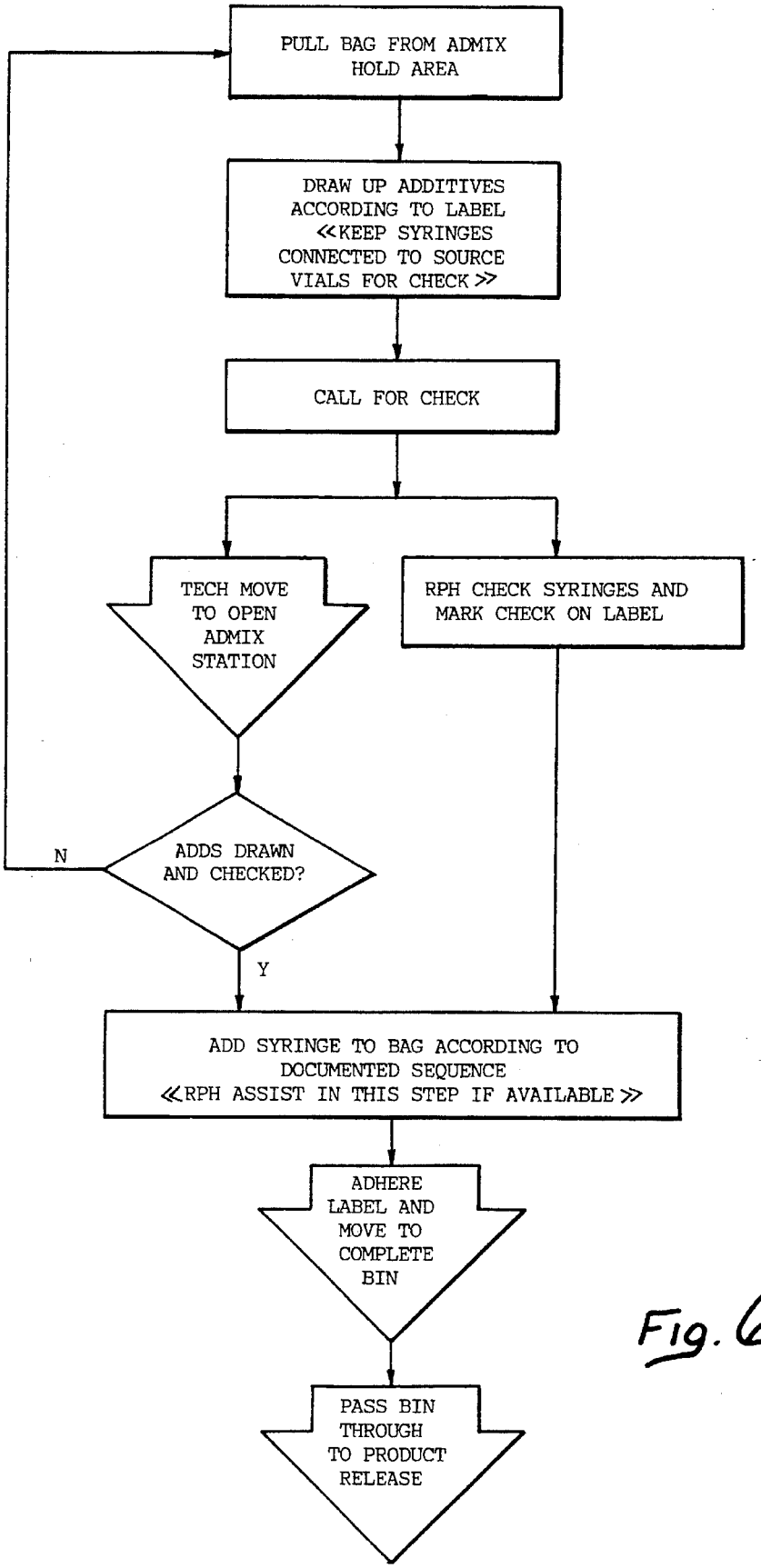
FIG. 6 shows a detailed process flow chart for the TPN admix process.
Figure 7A:
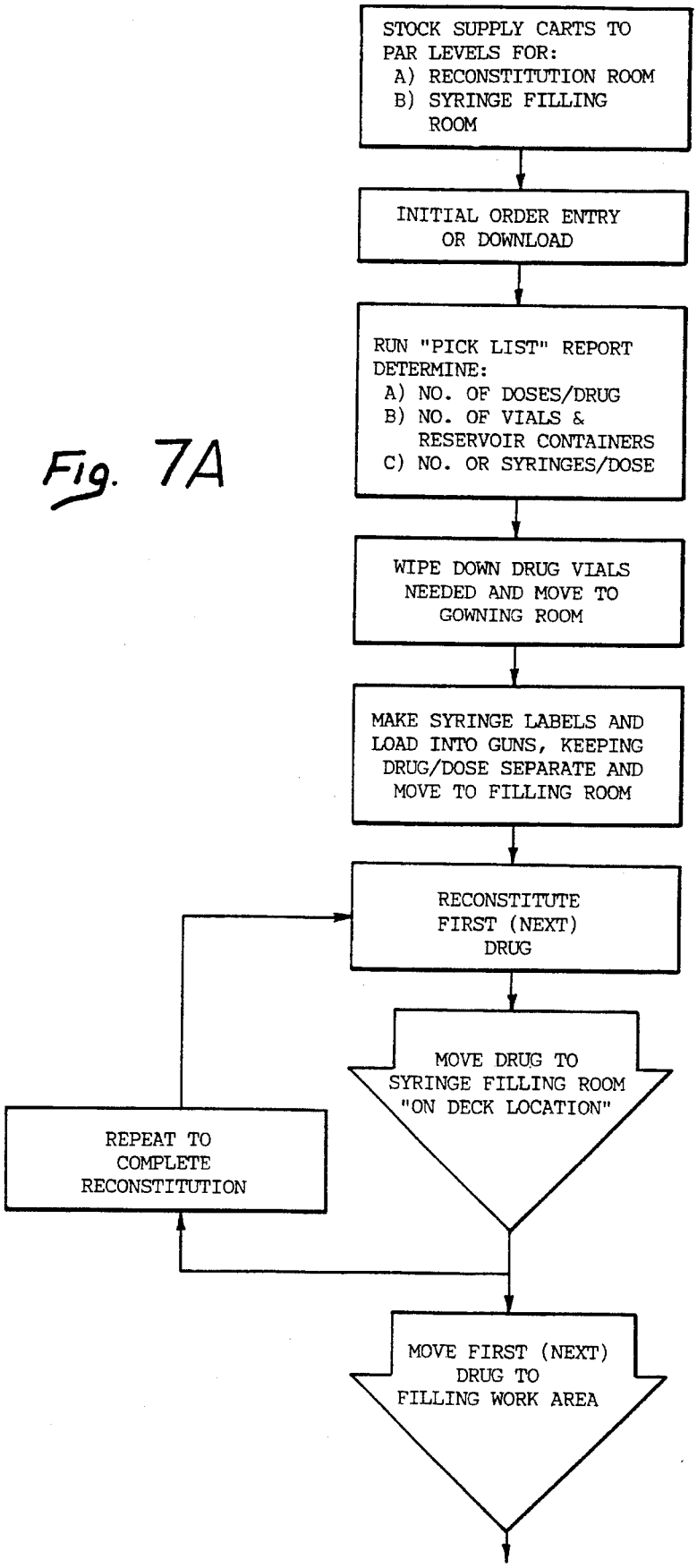
FIGS. 7A and 7B show a process flow diagram for the filling of syringes.
Figure 7B:
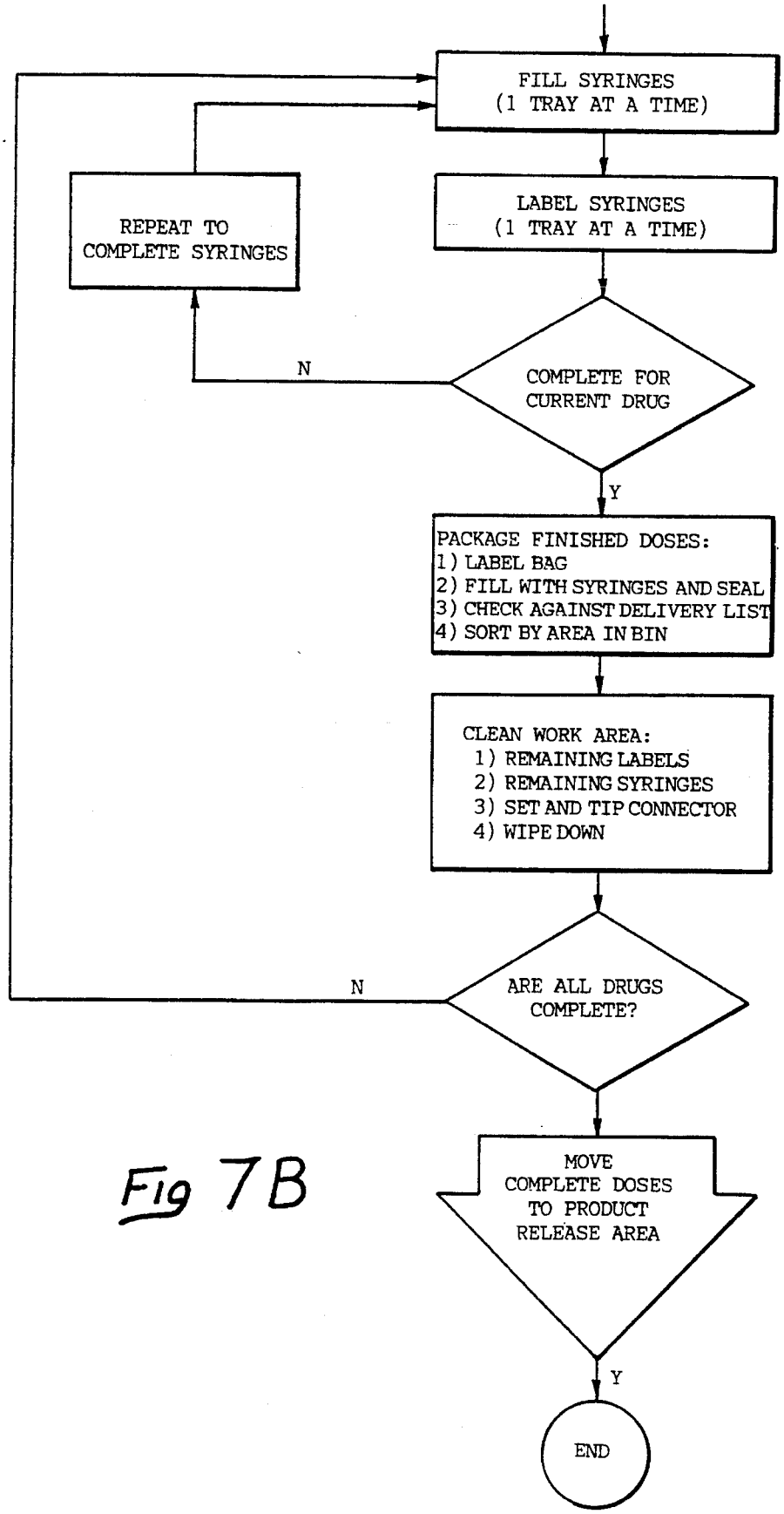

Referring now to FIG. 4, there is shown a schematic of the equipment used in the TPN compounding and filling room. As shown, each container 126 of solution has attached flexible tubing 150 which passes through a peristaltic pump 152.

The peristaltic pump 152 exerts pressure on the tubing 150 by means of rollers indicated at 154 in FIG. 4. Since only the rollers contact the tubing 150, the liquid flows through the flexible tubing 150 without coming into direct contact with the parts of the pump 152. This prevents the introduction of contaminants from the pump 152 into the solutions.

Downstream of the pump 154, the tubing 150 is attached to an air source, not shown, by means of a tube 156. Downstream of the tube 156 is attached a sterilizing 0.2 micron filter 158 which communicates with a reservoir 160 by means of tubing 162.

The air source or other gas source such as nitrogen is used for periodic inline testing of the filter 158. The testing takes place by passage of pressurized air or other gas through the wetted filter 158 and determining if any bubbles are produced which would indicate a loss of integrity of the filter.

The approximate capacity of an individual filter for filtration of a given volume of solution is known. The provision of an inline source of testing permits the periodic checking of the integrity of the filter as well as at the end of the approximate capacity. This avoids or minimizes the necessity of discarding product filled prior to any testing failure of the filter.

Transducer 166 communicates with controller 164 which turns pump 152 on and off as reservoir 160 empties and fills.

After completion of sterile filtration, the filter 158 is again tested to insure the integrity of the filter.

Figure 9:
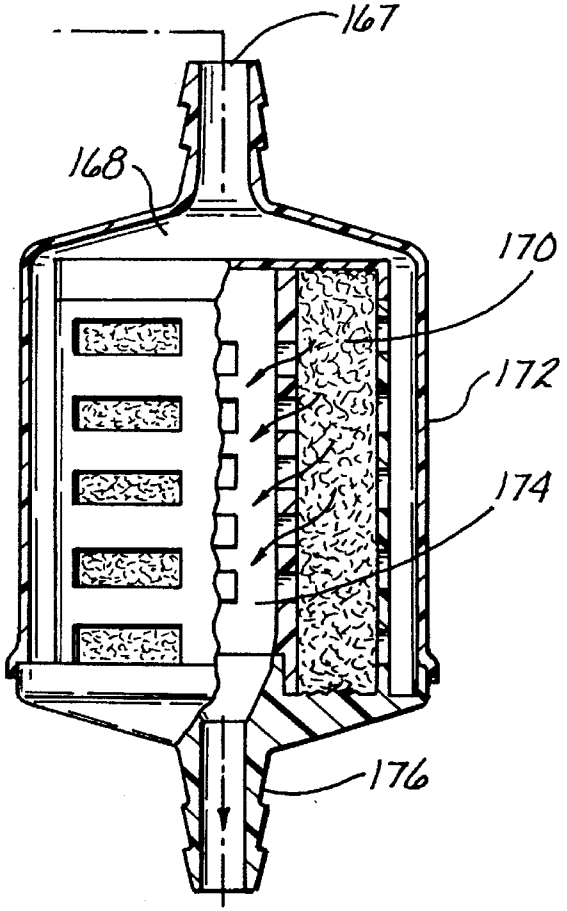

The preferred filters for use in the invention are sterile disk or sterile capsule filters, preferably a sterile 0.2 micron absolute filter as shown in FIG. 9.

The pass of filtration through the capsule filter of FIG. 9 proceeds through an integrally formed tubing connection 167 to just inside the exterior walls 168 through the filtration material 170 into a central passage 174 where it exits through an integrally formed tubing connection 176.

A schematic showing of the compounder 200 can be seen in FIG. 4. As shown, a reservoir 160 corresponding to each solution to be added communicates with a volumetric pump 202 including a series of rotors 204 and rollers 206 which are in contact with tubing from each of the solution reservoirs 160. The volumetric pump 202 is controlled by means of a computer 208 including a keyboard 210 and monitor 212. The computer 208 also communicates with a scale 214.

In operation, these extemporaneous mixed solutions are setup within the compounder 200 followed by calibration of the scale 214.

Preferably, the computer 208 accesses the prescriptions stored in the pharmacy central computer for selection of a patient name based on printed labels.

A clear plastic bag for receipt of the TPN solutions is connected to the compounder and placed on the scale 214. The bag, often called a transfer bag, is normally comprised of a clear plastic material such as polyvinylchloride sealed along its edges in a fluid tight relationship. It is available commercially in a sterile, sealed condition. The bag is provided with an aperture for hanging of the bag during the subsequent patient infusion process. In addition, there are usually two transfer ports and a fill port. The fill port has an integrally connected tube which terminates at its distal end in a spike spaced from a shoulder for ease in grasping. A clamp permits separation of the spike from the fill line without loss of product.

Prescription amounts of each of the TPN solutions from reservoirs 160 are metered into the bag by the computer 208 in conjunction with the pump 206 and checked by the weight on the scale 214.

For example, the pharmacist technician would pull a labeled bag and attach it to the end of the tubing of the compounder. With the specific patient prescription called up on the screen of the computer, the volume for each of these solutions to be added to the bag are then set.

A registered pharmacist then checks the volumes and marks a check on the label to indicate that they have been checked. At this point the compounder is started causing the bag to be filled with the prescribed amounts of the solutions. The computer signals when the filling is complete. The volume in the bag is then compared with the volume for the prescription as a double check. If all checks out then the bag is moved to the micro admix work station.

In this manner each patient order is filled and all the bags for one patient are kept together. At the microadmix work station, a syringe is connected to each individual microadditive solution vial. A syringe is then drawn for the prescription amount of each microadditive to be added according to the prescription. The syringes remain connected to the source vials for checking. After each of the components have been drawn up into the syringes, a registered pharmacist checks to make sure that the amounts of components and ingredients are correct.

If correct, each microadditive ingredient is then added sequentially to each TPN bag. When the microadditives have been added to the bag, a registered pharmacist double checks against the label and signs it off. When all of the bags are complete for a set of prescriptions, they are moved to the pass through which communicates with the product release room.

In the product release room corresponding to room number 42 of FIG. 1 and room number 104 of FIG. 2, which is held to a positive pressure of +0.01 inch of water, the set of prescriptions are checked and sorted based on a computer printout of a hospital delivery list and assembled with other prescriptions for patients residing on the same hospital floor. If all checks out correctly, the prescriptions are then ready for delivery to the hospital.

The following examples are given for purposes of illustrating the invention and are not intended to constitute a limitation thereof. References to the apparatus, work stations, rooms and equipment and the like are as described in the drawings.

EXAMPLE 1

PREPARATION OF TPN SOLUTIONS

A prescription for TPN solutions is received at the computer work station for 20 bags of 1000 ml volume. A pick list is prepared for raw ingredients, water, sterile TPN transfer bags, and sterile fill sets.

Pharmacist technicians enter the changing room 26 where they remove their street clothes and dress in surgical scrubs and a hair net, and scrub their hands with a germicidal soap. They load a cart with the premeasured bulk required materials in the raw material receiving and storage room 20 according to the pick list.

They take the cart into the hall 26 where the cart and equipment are wiped down with alcohol to remove particles and microorganisms. They move the cart into the process preparation room 28. Here the bulk raw materials are taken into the extemporaneous room 30 for compounding using the compounding cart as shown in FIG. 8.

The required amount of water for injection, U.S.P. prepared earlier in the day and verified for purity is added into a container 122 and a sealed bag of premeasured dry ingredients corresponding to bulk primary and secondary amino acids in powder form are emptied into the container. The mixer 134 is started and the hot plate 128 turned on.

At the same time the required amount of water for injection, U.S.P. prepared earlier in the day is added to a container 124 and a sealed bag of premeasured bulk dextrose powder is emptied into container 124. The mixer 136 is started and the hot plate 130 is turned on. Mixing is continued for about 5–10 minutes or until the powders are dissolved.

A sample of the amino acid solution and a sample of the bulk dextrose solution are taken to the control and testing room 32 where the specified values as to content and purity and pyrogen free is verified.

The cart of extemporaneous containers of mixed solutions is moved into the positive pressure wipe down room 36. Here the exterior of the containers and other equipment are wiped down with alcohol.

The cart and associated equipment needed for final compounding including the TPN sterile bags are wiped down with alcohol. The carts are then moved into the positive pressure vestibule 38 where class 100 gowns are put over the scrubs. The attached hood is pulled over the head, a face mask is put on and shoe covers and disposable booties are put on. Latex gloves are placed over the hands.

The carts are then moved into the TPN compounding room 40. The walls, floor, ceiling and mixing equipment within the compounding room have been previously washed with an antibacterial solution.

The compounder is set up substantially as shown in FIG. 4 at compounding work station 342. The microadmix work station 352 is also set up by placing vials of the required microadditives in a rack and attaching the proximal end of a sterile tubing set to each vial and a sterile syringe to the distal end of the sterile tubing set.

Both the compounding work station 342 and the microadmix work station 352 are provided with class 100 laminar floor air at a positive pressure of 0.1 inch of water. The air is flowed vertically downward over the compounder 342 during the compounding and filling processes.

The compounder 342 is set up with the containers 126 of filtered or premixed solutions of amino acids, dextrose, fats, and water. The volumetric pump is calibrated in conjunction with the computer 208 to dispense the prescription amounts of each of the solutions within containers 126.

A labeled TPN bag is then attached to the end of the tubing of the compounder 342. The compounder 342 is started causing the TPN bag to fill. The computer 208 signals when the filling is complete. The volume in the bag is then compared with the required volume for the prescription. If all checks out, the bag tubing is clamped and the end capped and moved to the microadmix work station 352.

The remaining TPN bags are filled in the same manner. When all of the bags have been filled, the integrity of the filter is then tested by passage of air through the filter. If no bubbles are produced, the filter is verified.

The microadditives are then added. Each of the required microadditives are drawn up in prescription amounts. A registered pharmacist then checks the amounts for accuracy against the specific label. When all is approved, each microadditive is then added sequentially to the bag. After addition of the required microadditives to each of the TPN bags, all fluid is caused to drain toward the bag and the tubing is sealed. All of the completed bags are then passed through to the product release room 42.

In the product release room 42, the TPN bags are grouped together in a package for a specific patient and labeled. The labeled packages are then placed in a bin for delivery to the hospital. The packages are then checked against the hospital delivery list.

EXAMPLE 2

PREPARATION OF ANTIBIOTICS

A prescription is received at the computer work station 300 in room 20 for 100 syringes containing 10 ml each of cefazolin sodium at a concentration of 100 mg/ml.

A pick list is prepared for 5/100 ml source vials containing 20 grams of cefazolin sodium powder and communicated to the raw materials storage room. The 5 source vials together with syringes and other needed equipment are placed on a cart.

In changing room 26, pharmacy technicians and registered pharmacists dress in scrubs and a hair net, and scrub their hands with a germicidal soap. They take the cart to the wipe down room 36 where the cart, vials and other equipment are wiped down with alcohol to remove particles and microorganisms.

The pharmacy technicians and registered pharmacists enter the vestibule 46 outside of the IVPB compounding room 52 with the wiped down cart. Here they don clean class 100 gowns over their scrubs. A face mask is placed over the face and the hood of the suit is pulled up over the hair net. Disposable sterile booties and shoe covers are put on. Sterile latex gloves are placed over the hands.

The cart is then taken into the antibiotic compounding room 52 to the antibiotic compounding work station 372. The 5 source vials are placed within the negative pressure class 100 biohazard laminar flow hood. A volumetric pump is set up with a new sterile tubing pump set-up consisting of a length of tubing which passes through the pump. The tubing has a fitting for attachment to a needle at its distal end and a fitting with a dust cap on the proximal end.

A container of distilled water is hung within the hood. The pump is then calibrated.

The outer enclosure on each of the five source vials is removed according to the manufacture's instructions to expose the outer cap. The pump is programmed to deliver 87 ml. A vented needle is attached to the distal end of the pump set tubing. The rubber stopper at the top of each vial is swabbed and then the needle dust cover is removed and the needle is inserted through the rubber stopper and 87 ml of purified water are injected into the vial.

Each of the four remaining vials are filled the same way with 87 ml of distilled water. Following the addition of water, the needle is removed and a dust cap is placed over the needle. Each vial is then gently shaken inside the hood.

A 2L clear plastic bag of the type used for TPN solutions is then hung within the biohazard hood. The pump is set to deliver 500 ml of water to the sterile closed container and the distal end of the tubing set is attached to the plastic bag. Next the proximal end of the tubing set attached to the water is attached to the clear plastic bag. The needle with the dust cap is attached to the distal end of the tubing set. The dust cap is removed and the needle is then injected into each container of antibiotic which has been previously mixed with water and the pump is reversed to empty the contents of each vial into the 2L plastic bag. Each of the vials is then emptied in the same manner. This results in a solution of 1000 ml of final diluted antibiotic. The container is then marked with the name of the drug and the dilution value.

The clamp which is used to hold the tubing set within the pump is removed. The needle is removed from the last vial, and a protective cap is placed on the distal end of the set. The entire tubing set is then thrown away in a special waste container.

The reconstituted antibiotic solution is then hung on an IV pole and then transported to the antibiotic filling room 54. The IV pole containing the antibiotic is then placed into a laminar flow class 100 filling hood 372. Within the hood is a volumetric pump which has been prepared with a sterile tubing set. The distal end of the set is clamped upwardly. A cart containing syringes of the needed volume together with syringe caps and a label gun containing labels are brought to the filling hood. The pump is then calibrated to deliver 10 ml per syringe at set intervals of 3 seconds. The number of cycles is set at 100.

A syringe is put onto the distal end of the tubing set, the pump is started, and each syringe is filled with 10 ml. Each syringe is closed with a syringe cap and placed in a bin containing only this drug. Using the label gun, the appropriate labels are then put on each syringe. When all of these syringes have been filled, there are 100 syringes each containing 10 ml with labels.

A registered pharmacist takes the patient specific label and places it on the outside of a resealable bag, inspects the prescription and places the required number of antibiotic syringes into each patient specific bag. The bag is then sealed and labeled. It is put into another bin for the hospital.

The bin is then transferred to the product release area and checked against the specific hospital's delivery list. It is then boxed into another bin and shipped to the hospital.

Various modifications of the invention are contemplated and can be resorted to by those skilled in the art without departing from the spirit and scope of the invention as defined by the following claims.

We claim:

1. A pharmaceutical system for the admixture of ultra-high purity intravenous solutions and drugs, said system comprising:

a plurality of work stations for completion of successive process flow steps in the admixture of intravenous solutions and drugs and comprising:

at least one work station for reception of patient prescriptions and generation of prescription labels comprising computer means for accessing and receiving a hospital's prescription data files for prescription orders;

at least one work station for raw materials receiving and storage;

at least one work station for compounding of solutions, for sterile microfiltration of said solutions, and for unit filling of IV bags or syringes;

at least one work station for cleaning or sterilization of work station equipment;

at least one work station for analysis, control and testing of solutions and equipment;

at least one work station for double checking labeled product for release thereof; and, environment control means comprising air filtration means to supply air in ultra-high purity form, at controlled pressure and temperature, to said plurality of work stations.

2. A pharmaceutical system according to claim 1 further comprising:

means for automatic computer download of prescription orders, means for accessing ASCII text files;

means for translating text and ASCII text files to said computer means process flow system computer files;

means for formatting ASCII text files in ANSI standard data format; and, means for computer analysis of a patient specific prescription as to at least one of height, weight, allergies, number of ingredients, concentration, and dosage.

3. A pharmaceutical system according to claim 2 further comprising:

means for including in a patient specific prescription the information as to at least one of the following information: prescription name; type of order as to parenteral nutrition, chemical, antibiotic, chemotherapy; a hospital defined patient ID number; patient name; ordering physician's name; hospital defined prescription number for order; sex of patient; height of patient; weight of patient; room where patient is residing at time of order; area or ward of hospital where patient is residing; known allergies of patient; diagnosis of patient; special instructions for prescription; number of units requested; rate of delivery for solution; total kilocalories required; total prescription volume in milliliters; duration of delivery; start prescription date; end prescription date; separate identification of each solution, additives, drug name; quantity or concentration including a unit of measure for each solution additive or drug name; frequency of inclusion by day, week, or month; and a total solution and additives count.

4. A pharmaceutical system according to claim 3 further comprising an order file summary comprising computer means for registering at least one of the following information: a record header, a type of order, a total count of orders, a total count of solutions and additives for said file, a sum of all unit quantities, a date said file was created, and a time of day said file was created.

5. A pharmaceutical system according to claim 1 wherein said raw materials receiving and storage station comprises computer means for communication with said prescription reception computer work station for inventorying raw materials, for computer communication of said inventory to said prescription reception work station, and for computer reception of a pick list of raw materials based upon prescription orders.

6. A pharmaceutical system according to claim 1 wherein:

said system includes at least one work station for compounding of intravenous total parenteral nutrition and extemporaneous solutions, at least one work station for compounding of intravenous general pharmacy and intravenous chemotherapy prescriptions, and at least one work station for compounding of intravenous antibiotic solutions.

7. A pharmaceutical system according to claim 6 wherein said general pharmacy compounding and chemotherapy work stations further comprise means for such compounding under a laminar flow class 100 biohazard hood to avoid contamination of the air with such compounds.

8. A pharmaceutical system according to claim 6 wherein said antibiotic work station further comprises means for compounding under a laminar flow class 100 biohazard hood.

9. A pharmaceutical system according to claim 6 wherein said work station for compounding TPN and extemporaneous solutions comprises a work station for extemporaneous compounding of solutions and a work station for microcompounding and filling, said extemporaneous compounding work station comprises means for weighing raw materials, means for introducing raw materials into a solution tank to form a solution, means for heating said solutions, means for mixing said solutions, and means for transporting said solutions from said macrocompounding of solutions work station to said work station for microcompounding and filling.

10. A pharmaceutical system according to claim 9 wherein said work station for microcompounding and filling of intravenous total parenteral solutions work station comprises:

a computer means in communication with said computer means in said prescription reception computer work station;

means for accommodating solutions produced in said extemporaneous compounding work station;

means for aseptic pumping of each solution through an aseptic 0.2 micron filter into a reservoir container;

means for dispensing metered amounts of selected solutions into an aseptic prescription container; and, computer means for control of the identity and amount of each solution which is introduced into each prescription container.

11. A pharmaceutical system according to claim 10 further comprising:

means for inline testing of filters, and means for the consistent, systematic introduction of small amounts of microadditive ingredients; and, computer control means for checking and dispensing the amount of said small amounts.

12. A pharmaceutical system according to claim 1 wherein said control and testing work station comprises:

means for individual testing of micron filters;

an incubator for incubating samples of filled prescriptions;

a refrigerator for cooling;

means for analysis of prescriptions and for verification of identity of prescription ingredients; and, means for testing the sterility of prescriptions as well as the sterility of equipment used in the preparation of the prescriptions.

13. A pharmaceutical system according to claim 1 wherein said cleaning and sterilizing work station includes means for washing, drying, and sterilizing of equipment and other items used in the preparation and testing of prescriptions.

14. A pharmaceutical system according to claim 1 wherein said product release work station comprises:

computer means in communication with said prescription reception computer work station for double checking of individual prescriptions prior to release;

means for packaging individual patient prescriptions together; and, means for maintaining prescriptions at prescribed temperatures.

15. A pharmaceutical system according to claim 1 further comprising at least one area for changing from street clothes into sterile clothing.

16. A pharmaceutical system according to claim 1 further comprising a work station for wipe down of all solutions and associated equipment prior to set up in said compounding and unit fill work station in order to remove particles and maintain sterility.

17. A pharmaceutical system according to claim 1 further comprising a work station for ultra purification of water and the storage thereof.

18. A pharmaceutical system according to claim 17 wherein said water purification system further comprises at least one means selected from reverse osmosis filters, carbon bed filters, ion exchange beds, chemicals to kill organisms, filters to remove particles, mixed bed polishing containing cation and anion exchange resins, sterilization means and distillation and evaporation operations for production of water to the pharmaceutical standard of Water For Injection, U.S.P..

19. A pharmacy comprised of at least one modular structure divided interiorly into separate rooms and areas for performing specific activities for the admixture of ultrapure intravenous solutions and drugs comprising:

at least one area for prescription order entry for receipt of prescriptions comprising computer means for accessing and receiving a hospital's prescription data files for prescription orders;

at least one changing area for donning sterile work garments;

at least one control, analysis, and testing area for analysis of prescriptions and for testing for sterility of prescriptions and equipment;

at least one process preparation area for washing and sterilizing of equipment; and for weighing out and measuring raw materials;

at least one area for extemporaneous compounding of prescription solutions;

at least one area for wipe down of exterior portions of equipment prior to use in compounding and unit filling of prescriptions;

at least one positive air pressure area for total parenteral nutrition compounding, sterile microfiltering and filling;

at least one negative air pressure biohazard hood for general pharmacy, antibiotic and chemotherapy compounding and filling; and, at least one area for product release.

20. A pharmacy according to claim 19 further comprising at least one area for raw materials receiving and storage and at least one area for water purification.

21. A pharmacy according to claim 19 further comprising means for controlling said general pharmacy compounding and said antibiotic compounding areas and maintaining the air therein to a class 1000 standard or better; and, means for maintaining said total parenteral nutrition compounding and filling enclosure to a positive air pressure of at least about +0.1 inch of water and maintaining air therein to a quality of class 1000 standard or better.

22. A pharmacy according to claim 19 further comprising means for maintaining said control and testing area, said process preparation and cleaning and sterilizing equipment area, and said area for water purification to a positive air pressure of at least about +0.02 inch of water and a class 10,000 or better standard.

23. A pharmacy comprising:

at least one structure divided interiorly into separate rooms for performing specific process flow activities for the production of ultrapure intravenous solutions and drugs comprising:

at least one ambient air pressure room for raw materials receiving and storage, for receiving prescriptions, and for changing into scrubs;

at least one positive air pressure room for control and testing of prescriptions, for process preparation, for cleaning and for sterilizing of equipment used in the preparation of prescriptions, for large scale compounding of solutions, for wipe down of equipment used in TPN compounding and filling, for changing into sterile gowns and related apparel, for TPN microcompounding, filtering and filling, for unit filling of antibiotic prescriptions, and for release of filled prescription products; and, at least one separate negative air pressure room for compounding of general pharmacy and chemotherapy drugs and at least one separate negative air pressure room for compounding of antibiotics; and, a biohazard hood disposed within each negative air pressure room for the compounding of the prescription drugs within each room.

24. A pharmacy according to claim 23 further comprising a positive air pressure of at least about +0.2 inch of water and a class 10,000 or better standard for said positive air pressure rooms including said at least one room for control and testing of prescriptions, for process preparation and cleaning and sterilizing of equipment, and for large scale compounding of solutions;

a positive air pressure of at least about +0.05 inch of water and a class 1000 or better standard for said at least one room for changing into scrubs, a positive pressure of at least about +0.1 inch of water and a class 1000 or better standard for said at least one room for TPN compounding and for antibiotic filling, and a positive pressure of at least about +0.01 inch of water for said at least one room for product release; and, a negative air pressure of at least about −0.1 inch of water and a class 1000 or better standard in said general pharmacy compounding and chemotherapy compounding room and for said antibiotic compounding room.

25. A pharmacy according to claim 23 further comprising a room for water purification which is maintained at a positive air pressure of at least about +0.02 inch of water and a class 10,000 or better standard for said air.

26. A process for admixture of ultrapure intravenous solutions and drugs comprising:

receiving prescription orders;

analyzing each prescription order at least with respect to identity of ingredients and amounts thereof;

preparing a list of needed materials, equipment and sterile prepared solutions;

wiping down the exterior of each container of materials and prepared solutions, and equipment, attached equipment and transport equipment;

transferring said wiped down containers, materials and equipment to form individual TPN prescriptions and extemporaneous solutions to a prescription compounding and filling room substantially free of pathogenic organisms and having a controlled air flow environment with positive air pressure and provided with a class 1000 or better standard;

admixing at least one of the extemporaneous solutions and large scale batch TPN compounding solutions extemporaneously as needed wherein the steps comprise:

analyzing each prescription order at least with respect to identity of ingredients and amounts thereof;

preparing a list of needed raw materials and prepared solutions;

transferring raw materials on said list to a process preparation area for weighing and measuring of said materials;

mixing together needed raw materials and prepared solutions to form said extemporaneous and large scale batch solutions;

sampling each solution batch;

testing and analyzing each batch solution for quality;

releasing each extemporaneous and batch solution for use in filling prescriptions;

wiping down the exterior of each extemporaneous and large scale solution container, attached equipment and transport equipment;

transferring each container of extemporaneous and large scale batch solutions to a prescription compounding and filling room substantially free of pathogenic organisms and having a controlled air flow environment with positive air pressure and a class 100 or better standard;

checking each prescription at least as to identity of ingredients and amounts thereof;

filtering each said extemporaneous and large scale batch solutions through a sterile micropore filter sized to exclude pathogenic organisms;

metering prescription amounts of each said sterile prepared solutions and each filtered extemporaneous and large scale batch solution according to the prescription amounts into individual unit bags;

checking for any prescription changes;

adding individual sterile microadditives to each unit bag according to each individual prescription;

rechecking for each prescription ingredient; and, releasing the filled prescription product.

27. A process according to claim 26 further comprising receiving prescription orders by means of a computer:

analyzing each prescription order as to ingredients and amounts by means of computer analysis;

preparing a label identifying individual ingredients, strengths, and amounts; and, controlling the metering of large scale solutions by computer.

28. A process according to claim 26 further comprising:

adding microadditives by verifying the prescription ingredients and dosages separately;

drawing a syringe with the required amount of the additive;

reverifying the ingredient, the amount, and the concentration as required by the prescription; and, adding to a unit bag; and, repeating the above procedure for each individual microadditive required.

29. A process according to claim 26 further comprising verifying the integrity of the filter inline periodically and at the end of a prescribed amount of use.

30. A process according to claim 29 further comprising arranging each microadditive solution in a sequential order corresponding to the same order in which such micro ingredients are listed on a prescription label;

adding each microadditive in the same order as found on the prescription label and double checking prior to the addition of each subsequent microadditive;

drawing additives into syringes in the sequence stated on the prescription label;

keeping the syringe attached to the drug solution for checking;

verifying check of drawn syringes prior to adding; and, adding according to setup sequence.

31. A process for admixture of ultrapure intravenous solutions and drugs comprising:

receiving and accessing a hospital's prescription data files for prescription orders by computer means;

analyzing each prescription order at least with respect to identity of ingredients and amounts thereof by computer means;

preparing a list of needed materials, equipment and sterile prepared solutions;

wiping down the exterior of each container of materials and prepared solutions, and equipment, attached equipment and transport equipment;

transferring said wiped down containers, materials and equipment to form said prescriptions to a prescription compounding and filling room substantially free of pathogenic organisms and having a controlled air flow environment with negative air pressure and provided with a class 1000 or better standard;

checking each prescription at least as to identity of ingredients and amounts thereof;

metering prescription amounts of each presterilized solution according to the prescription amounts into individual unit containers;

checking for any prescription changes;

rechecking for each prescription ingredient; and, releasing the filled prescription product.

* * * * *